United States Patent [19]

Felter et al.

[11] Patent Number: 4,528,569

[45] Date of Patent: Jul. 9, 1985

[54] EARTH STATION ANTENNA ASSEMBLED ON SITE

[76] Inventors: John V. Felter, P.O. Box 6474, Houston, Tex. 77008; John G. Campsmith, 16434 Delozier, Houston, Tex. 77040

[21] Appl. No.: 449,396

[22] Filed: Dec. 13, 1982

[51] Int. Cl.[3] ..... H01Q 15/16

[52] U.S. Cl. ..... 343/840; 343/882; 343/916

[58] Field of Search ..... 343/840, 880, 881, 882, 343/912, 914, 915, 916

[56] References Cited

U.S. PATENT DOCUMENTS 3,235,872 2/1966 Schepis ..... 343/912

4,201,991 5/1980 Vines ..... 343/915

4,458,251 7/1984 Bondon ..... 343/916

*Primary Examiner*—Eli Lieberman

*Attorney, Agent, or Firm*—Carl B. Fox, Jr.

[57] ABSTRACT

Earth station antenna and method for assembly wherein the antenna has a frame made up of accurately stamped radial ribs and circularly disposed cross members, the frame being filled in by either sheet metal segments or by screen mesh segments to form a parabolic surface. The ribs are supported by a central ring or barrel, which is rotatable during assembly, and by back braces which are adjustable to bring the ribs to true parabolic positions and to tune the completed antenna. Assembly may be done from the ground by rotation of the central barrel. Novel connection means and a positioning gage are used during assembly of the antenna.

9 Claims, 11 Drawing Figures

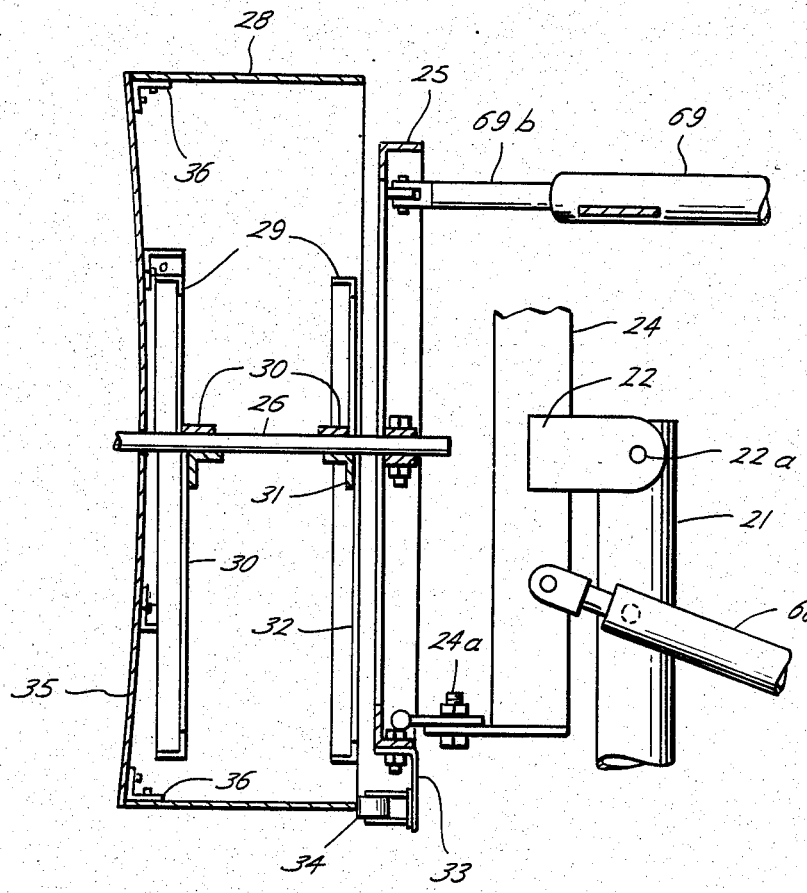
Fig. 10
Fig. 11
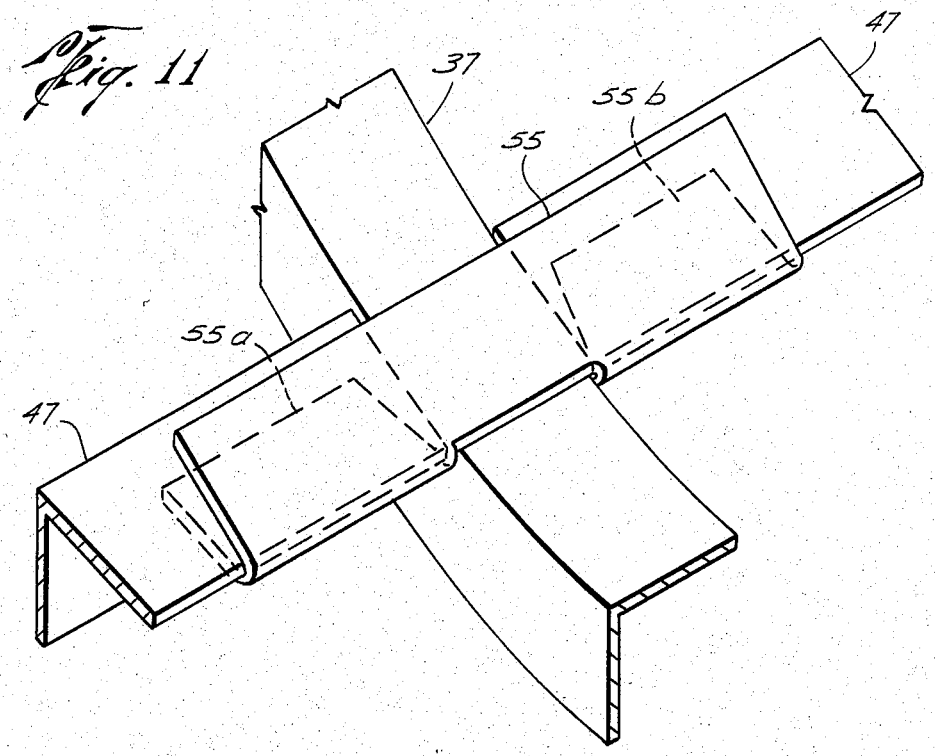

EARTH STATION ANTENNA ASSEMBLED ON SITE

BACKGROUND OF THE DISCLOSURE

The earth station antennas known in the art, designed for reception of television and other signals from satellites, are both expensive and inefficient. It is difficult to form an antenna surface of, say, twelve foot diameter, without considerable surface distortion. Molding of parabolic surfaces for antennas of such a size is expensive because the base or die is expensive and difficult to form and because the antenna surface, once formed, is structurally weak and tends to become warped and out of shape through handling, temperature changes, wind effects, and the like. Antennas formed of fibreglass most always are formed of edge-overlapped portions, and the overlaps of the sections causes considerable antenna surface distortion. The solid-faced antennas have high wind resistance, and are thereby highly affected when subjected to strong winds. Furthermore, once such a shape is formed or made, it may not be altered for tuning, so that optimum reception is virtually unobtainable. This invention seeks to provide an earth antenna of the type referred to, which is rigid and strong, which is light in weight, which is assembled from pre-shaped parts, and which may be accurately assembled and may be tuned to optimize reception after it has been assembled.

SUMMARY OF THE INVENTION

The earth station antenna according to the invention includes a frame made up of accurately die-stamped parts which are quickly and efficiently assembled into a completed frame. The frame is covered either by sheet metal or screen panels to form the receiving surface. Use of screen panels reduces wind resistance of the antenna. The elements of the frame may be adjusted as to position during or after assembly in order to tune the antenna for optimum reception. A principal object of the invention is to provide an earth station antenna which is efficient yet inexpensive. Another object of the invention is to provide such an antenna which may be readily transported in unassembled form and assembled at the place of use. A further object of the invention is to provide such an antenna which is assembled from accurate die stamped parts so that its structure is uniform and accurate over its entire surface. Yet another object of the invention is to provide such an antenna which is inexpensive, easily assembled, and economical.

Other objects and advantages of the invention will appear from the following detailed description of a preferred embodiment, reference being made to the accompanying drawings.

BRIEF DESCRIPTIONS OF THE DRAWINGS

FIG. 10 is a vertical cross section showing the support assembly of the antenna apparatus.

FIG. 11 is an elevation showing an assembly clip used in the assembly of the apparatus.

DESCRIPTION OF THE PREFERRED EMBODIMENT

Figure 2:
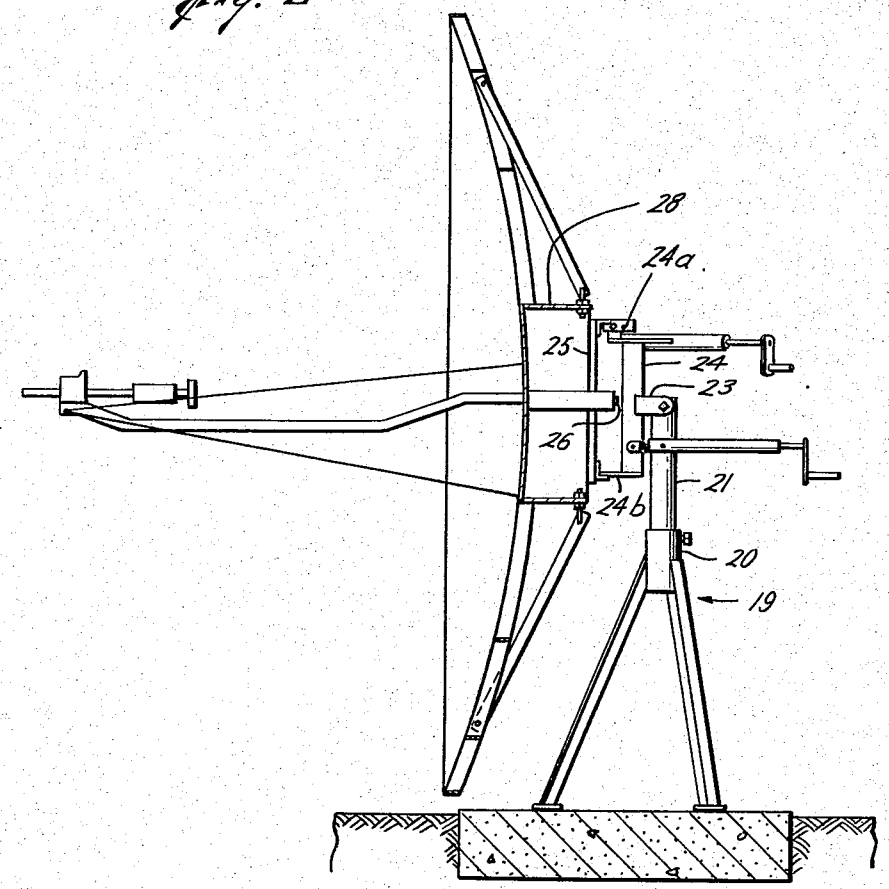
FIG. 2 is a vertical cross section of the antenna shown in FIG. 1, taken at line 2—2 of FIG. 1.
Figure 1:
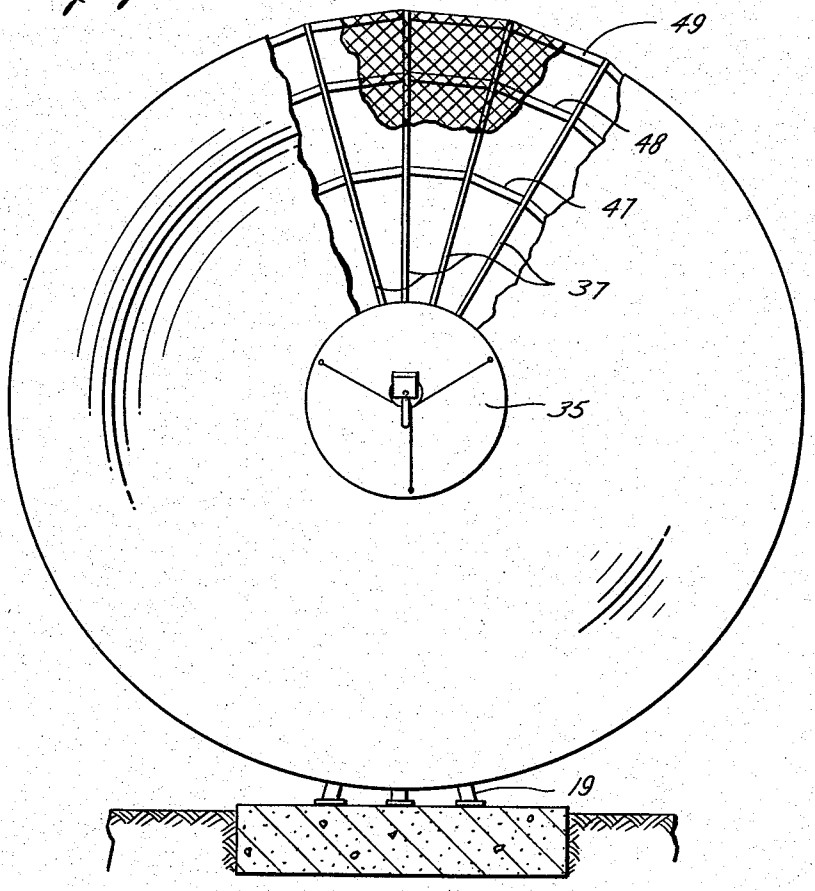
FIG. 1 is a front elevation of an antenna of preferred form according to the invention, partly cut away to show the rearward frame structure.
Figure 3:
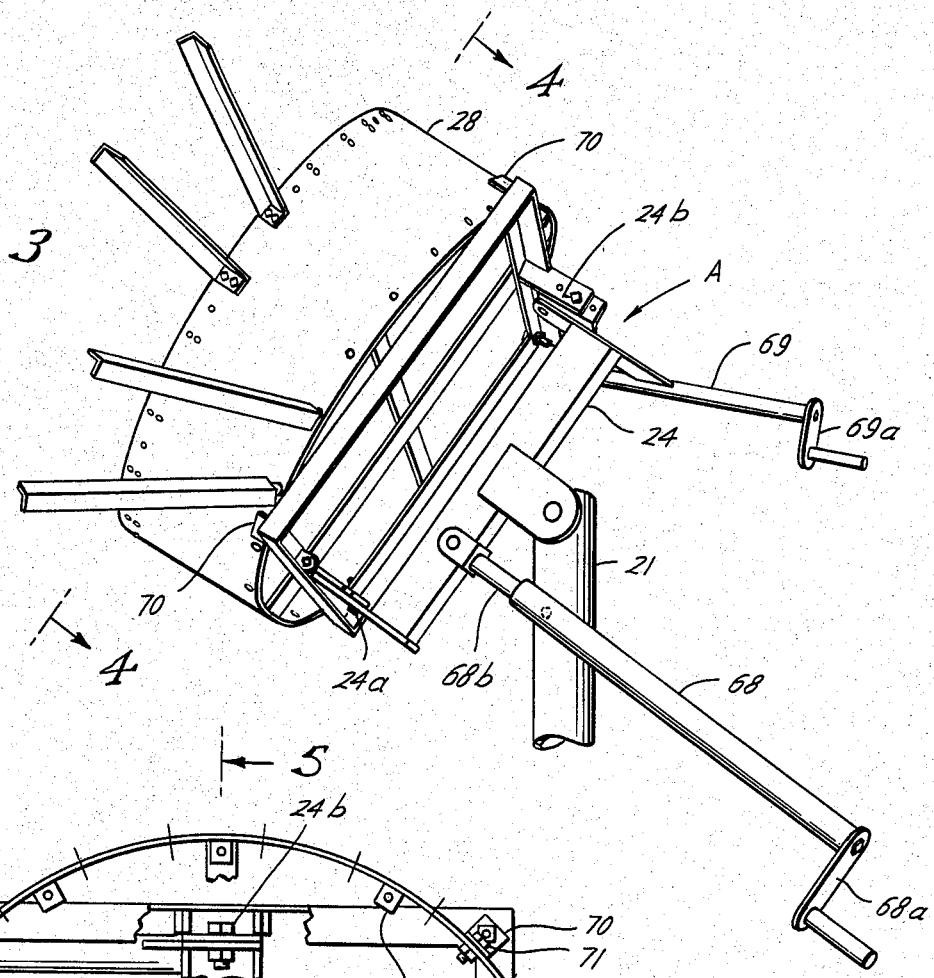
FIG. 3 is a partial perspective view showing a portion of the antenna structure.
Figure 4:
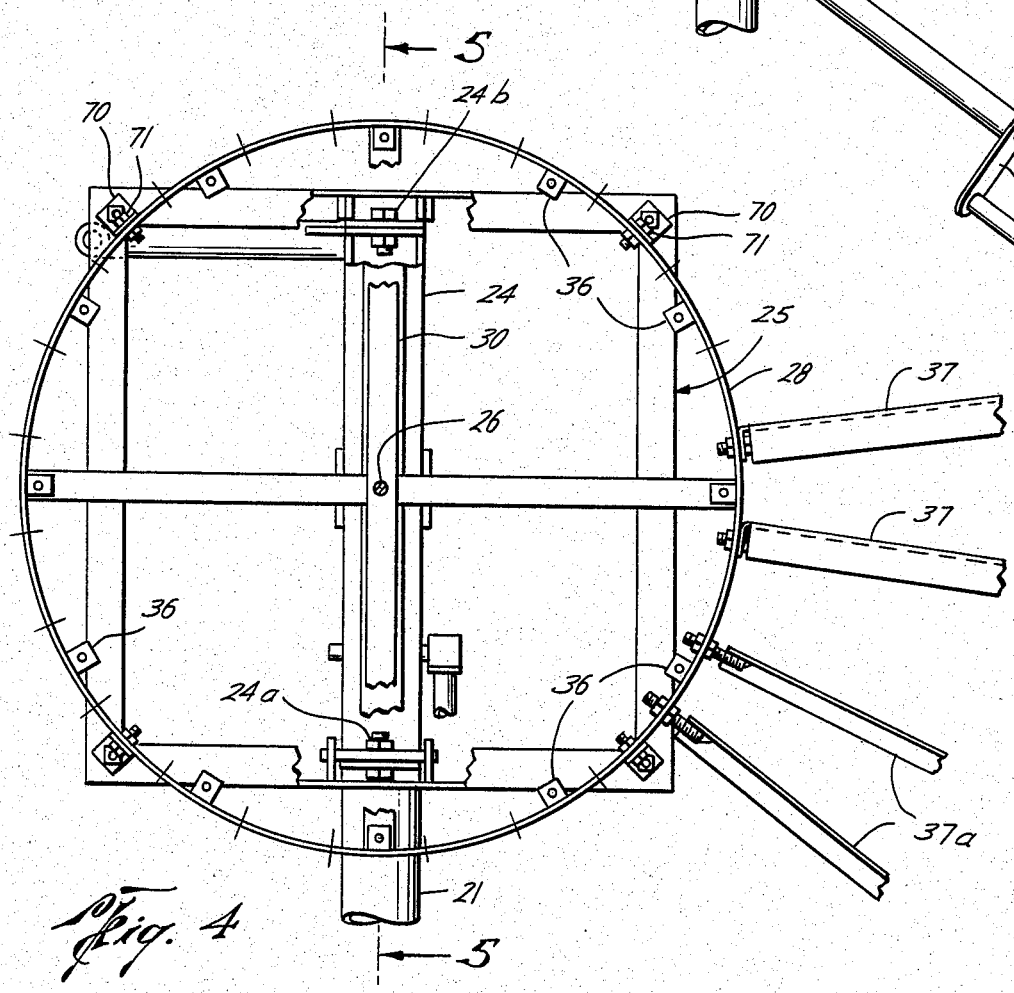
FIG. 4 is an elevation taken at line 4—4 of FIG. 3.
Figure 6:
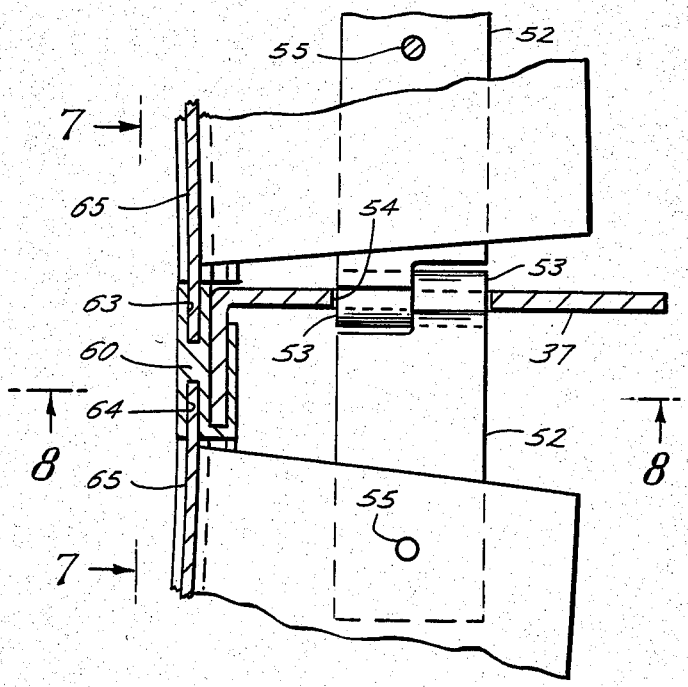
FIG. 6 is a partial elevation taken at line 6—6 of FIG. 5.

Referring now to the drawings in detail, and first to FIGS. 1 and 2, a tripod support 19 has an upstanding tube 20 into which a cylindrical shaft 21 is closely but rotatably received. Shaft 21 is pivotal about its vertical axis. Pivotal polar mount 22 at the upper end of shaft 21 has an outwardly facing yoke 23 into which a bar 24 is fixed at its center. A square frame 25 is made up of four members of angular cross section, i.e. angle irons welded together at their corners. Frame 25 is pivotally connected to the upper and lower ends of bar 24 at **24*a* and 24*b*, for sideways pivotal movements. Outwardly extending mounting bar 26 is cylindrical and is supported at the center of frame 25 in a hole through crossbars 25*a*, 25*b* of frame 25. A short cylindrical tube 28 has two crossed pairs of angle irons 29, 30, which at their crossings have circular perforations through which mounting bar 26 extends. Tube 28 is, therefore, concentrically rotatable about mounting bar 26. A bracket 33 is removably bolted to the lower side of frame 24 (FIG. 10) and bracket 33 carries a roller assembly 34 at a position to bear against the lower side of tube 28. As tube 28 is rotated about bar 23, the periphery thereof rolls on roller 34. This engagement positions cylinder 28 with regard to the length of bar 23 and provides clearance with frame 24. A parabolic plate 35 is connected to the left hand end of tube 28 by a plurality of circularly spaced L-shaped brackets 36 which are bolted to plate 35 and to tube 28**, as shown.

A plurality of ribs in the form of radial arms 37 are bolted at their inner ends to the forward edge of cylinder 28. While arms 37 are described as "radial" arms, actually they are of parabolic curvature, being bent forward of cylinder 28 toward their outer ends. The arms 37 are of L-shaped cross section having one flat surface facing the front of the apparatus and the other flat surface being disposed parallel to bar 23. A plurality of angular braces **37*a* of L-shaped cross section each having their outer ends bolted to one of the arms 37, at 38, the inner end of each brace 37*a* having a threaded screw 39 welded thereto at 40, the screw 39 passing through a perforation in cylinder 28 and connected thereto by inner and outer nuts 42, 43. The connection at 42, 43 is adjustable so that the effective length of the brace 37*a* may be adjusted in order to bring the arm 37** into the proper location at the parabolic contour of the antenna.

Figure 5:
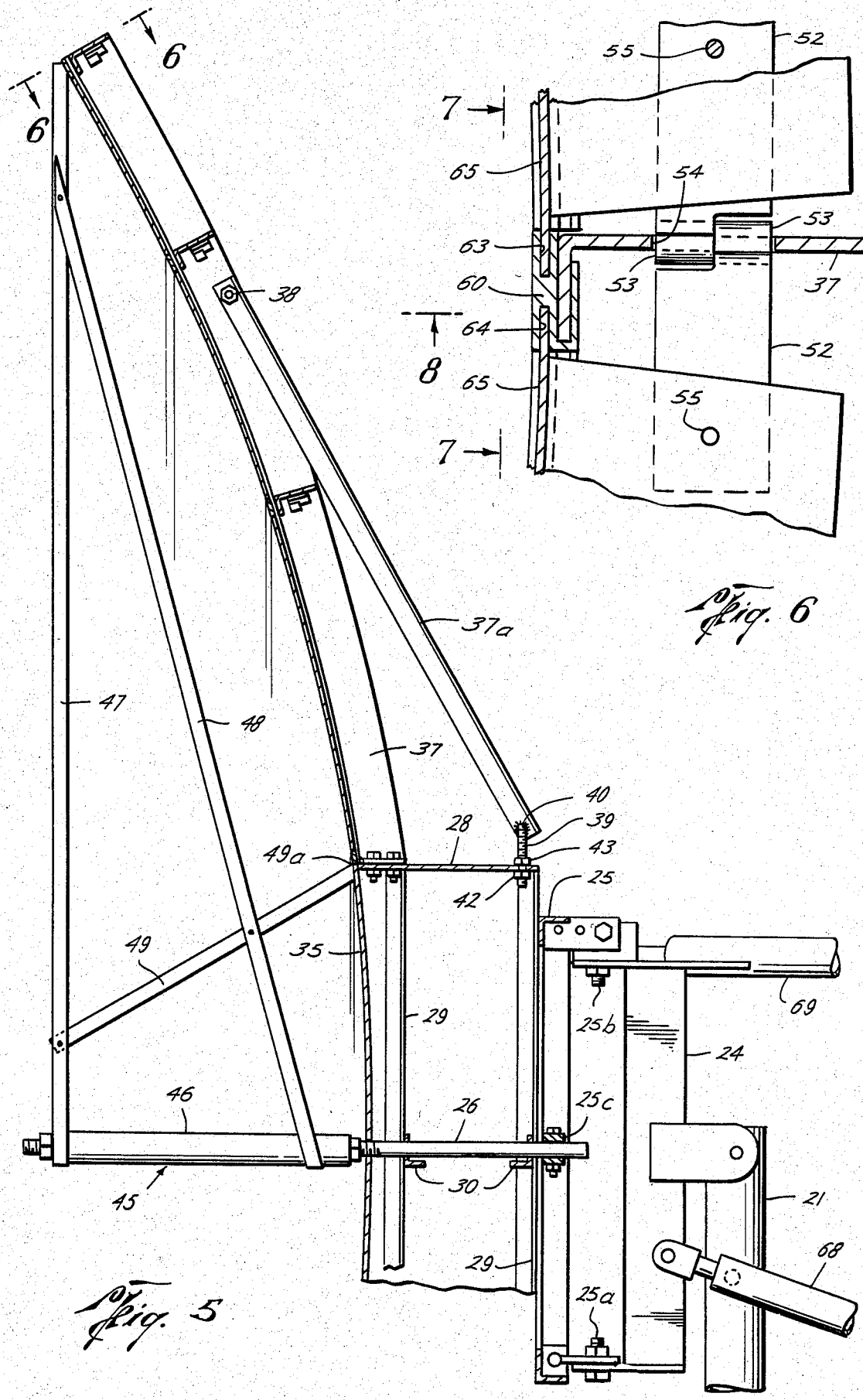
FIG. 5 is a vertical cross section taken at line 5—5 of FIG. 4.
Figure 7:
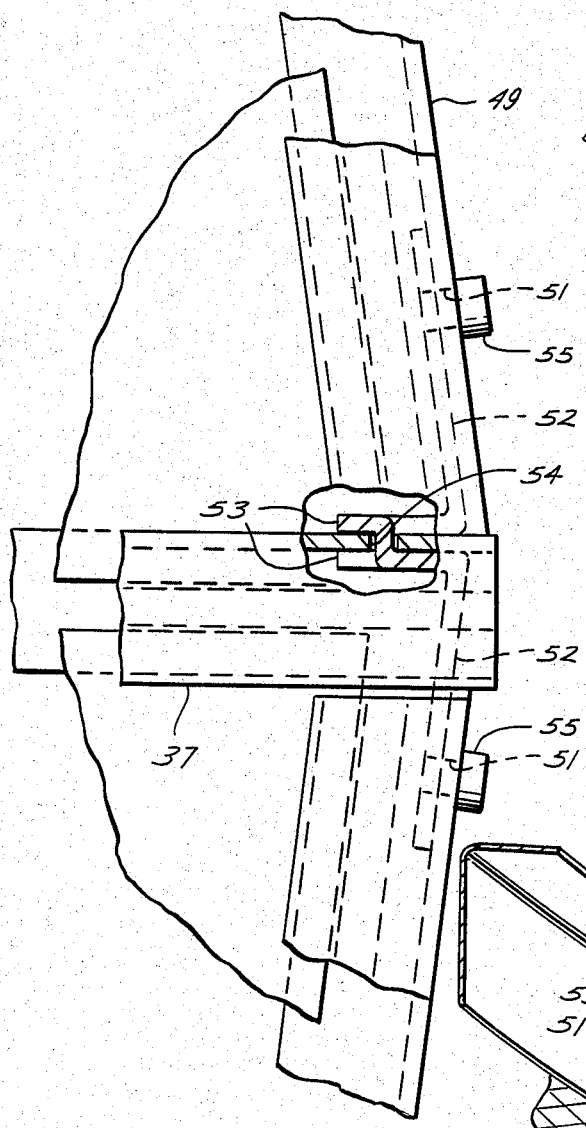
FIG. 7 is an elevation taken at line 7—7 of FIG. 6.

A gage assembly 45 (FIG. 5) is used to accurately set the positions of the arms 37. Assembly 45 includes a sleeve 46 which closely yet rotatably fits around bar 26, an outwardly extending bar 47, and an angularly extending bar 48, these being riveted together as shown and there being a cross bar 49 connected therebetween having a shaped tip **49*a* adapted to touchingly engage the edge of plate 35. The outer end of bar 47 is shaped and is adapted to touchingly engage the outer end of the arm 37 when the arm 37 is in perfect parabolic position. The assembly 45 is rotatable about bar 28 to be used in fixing the positions of all of the arms 37, usually 24 in number. The arms 37 are connected by plural successively longer cross members 47, 48, 49 to complete the framework for the parabolic antenna surface. The members 47–49 have circular curvature in one direction and parabolic curvature in the transverse direction so that when they are connected between the arms 37 they present faces defining the parabolic curvature of the antenna. The cross members 47–49 are preferably connected to the arms 37 in the manner shown in FIGS. 6–9. Adjacent each of its ends, each cross member 47–49 has a slotted bolt hole 51. A connector clip 52 has a shaped insert portion 53 which is inserted through a slot 54 of the arm 37. The cross members are held in position at arm 37 during assembly by a special alignment tool 55 as shown in FIG. 11. While the tool 55, having return bend tabs 55*a*, 55*b* which grip the members 47–49 tightly, holds the cross members 47 (or 48, 49) in place with their ends aligned adjacent the arm 37, the clips 52 at each side of arm member 37 (not shown in FIG. 11) may be put into position with the shaped portions 53 inserted through the slot 54 and then the bolts 51 may be connected to fasten the cross members 49 to the arm 37. The insert portions 53 of the clips 52 are of half width, so that the insert portions 53 of two clips 52 may be inserted from opposite directions through the slot 54 at the same time. Thus, the insert ends 53 are in place through slot 54, and with the clips bolted to the cross members 47, 48, or 49, the clips may not be withdrawn from the slots 54 and the cross pieces are fixed rigidly in place quickly and easily. The tool 55 aligns the outer surfaces of all connected members 37, 47, 48, 49** in the desired parabolic contour during assembly.

In the same manner, all of the cross pieces 47, 48, 49 are connected to the arms 37 completely around the apparatus and a rigid antenna frame is thus created with all of the outer faces of the frame members defining the parabolic contour. The angular position adjusting braces **37*a* contribute greatly to the rigidity of the antenna frame. The bolts and nuts which connect the clips 52 to the cross members 47–49 are referred to by reference numeral 56. Preferably, the nuts and bolts 56 are put into place loosely through the clips 52 and the true positioning of the arms 37 is adjusted at nuts 42, 43 before the nuts and bolts 56 are tightened. It should be noted that the slot holes 51 permit adjustments in the positions of the clips 52. After each cross member connection to an arm 37** is made, the clip used during assembly is moved to another connection location.

Figure 8:
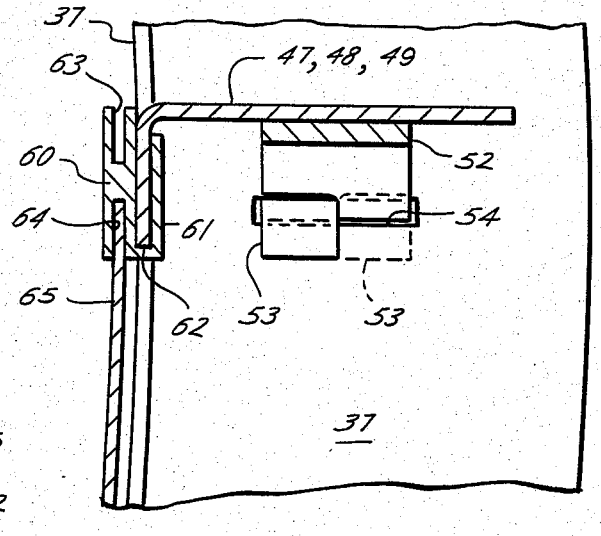
FIG. 8 is a transverse cross section taken at line 8—8 of FIG. 6.

After the frame consisting of the radial bar or arm members 37 and the cross members 47, 48, 49 has been assembled, the antenna must be provided with a complete parabolic surface, and this surface may be formed of either sheet metal, such as aluminum sheeting, or of wire mesh, such as aluminum screen wire. Referring to FIG. 8 of the drawings, the strips 60 are affixed to the cross members by placing the back element 61 at the underside of the part 62 of a bar member 37 or a cross member 47, 48, or 49. The strips 60 are placed on all cross members as well as on all of the radial arms 37. The openings 63, 64 of the strip 60 are adapted to receive the edges of sheet metal plates 65. The strips 60 are first placed around the inner and two radial sides of the inner smaller openings between the arms 37, and a cut-to-size sheet metal plate 65 is placed therein. Then, a strip 60 is placed at the outer cross member 47 side of the sheet metal plate and at the two opposite sides of the extending part of the arm 37. At this point another sheet metal plate pre-cut to fit in the second section between the members 37 is put into place and a strip 60 placed at its outer side at the cross member 48. This process is repeated at all of the segment portions of the antenna surface until the entirety thereof is closed by sheet metal plates 65.

When the antenna surface is covered by screen wire, screen wire pie shaped sections adapted to fit between the radial arms 37 are precut to size and fixed to the members 37 and the cross members 47–49 by means of a plurality of sheet metal screws. Adjacent pieces of screen wire are overlapped at the radial arms 37. Either the sheet metal panels 65 or the screen mesh serves suitably well for antenna reception. The principal thing which contributes to improved reception of an antenna of this type is the conformity of the antenna to a true parabolic contour. Since the positions of the arms 37 may be adjusted during and after assembly to more accurately coincide with the parabolic contour, the antenna is of highly sensitivity and improved reception characteristics. The positions of the frame 24 and of the antenna itself may be adjusted by means of the two adjustments screws 68, 69. When adjustment screw 68 is rotated by means of the crank **68*a* shown at its outer end, the shaft 68*b* is extended to pivot frame 24 about pivot pin 22*a*. Thereby, the angle of bar or shaft 23 may be changed from horizontal to some upwardly directed angle. When the crank 69*a* of adjustment screw 69 is rotated the shaft 69*b* is extended to pivot frame 24 about its pivot mounting at bolts 24*a*. Therefore, the antenna may be rotated about the bolts 24*a*** to alter compass direction in which it is disposed.

After the antenna parabolic surface has been completed, the roller 34 may be removed, and the barrel 28 is then bolted to frame 24 by use of angle brackets 70 and bolts 71. The earth station antenna according to the invention may be efficiently assembled according to the assembly steps which appear hereinafter. The location of the antenna must have a clear view of the southern sky. A check should be made of local building codes for any restrictions which would apply to the installation. As a foundation for the antenna, it is preferred that a concrete pad five feet square and ten inches deep be prepared or that a concrete foundation eighteen inches in diameter by forty two inches deep surrounding a straight pipe base be provided. Whether the tripod base shown in FIG. 2 or a straight pipe base be provided, the pipe should be approximately fifty-two inches from the ground.

Assembly steps:

1. Insert polar mount 21 into upper end of upright pipe support or into upper opening of tripod 19, depending on which type of support is used.
2. Assemble square frame 25, with bar 24 attached thereto, to yoke 23.
3. Assemble elevation adjustment screw 68 between bar 24 and member 21.
4. Adjust square frame 25 to horizontal position.
5. Use vertical adjustment screw 68 to set proper declination angle for the latitude of the installation.
6. Assemble lateral adjustment screw 69 between square frame 25 and bar 24, to be used for satellite tracking during later use of the antenna.

Figure 9:
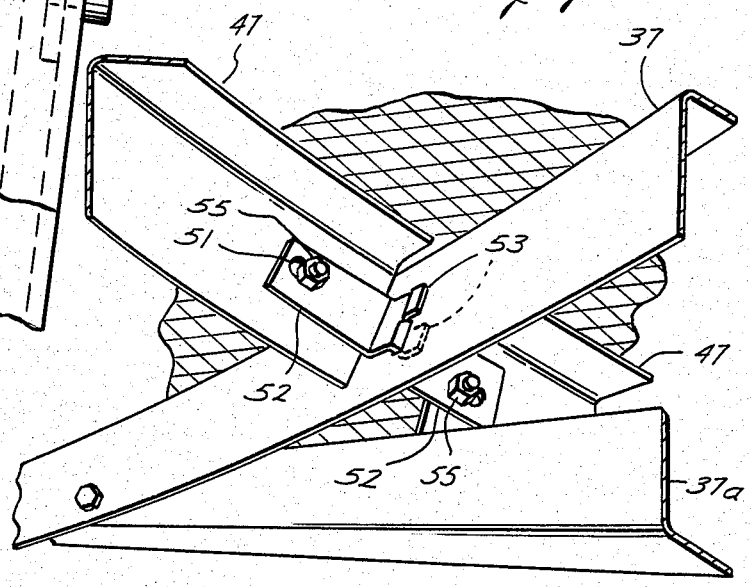
FIG. 9 is a perspective view showing an assembly structure of the antenna apparatus shown in FIGS. 1–8.

7. Lower square frame 25 to vertical position with adjustment screw 68.
8. Insert mounting bar 26 into center hole of square frame 25.
9. Install bracket 33 and roller 35 at bottom of square frame 25.
10. Place ring 28 on mounting bar 26 and slide until lower edge of ring 28 engages roller 34. The ring 28 should be about one inch from square frame 25 and should rotate freely against roller 34.
11. Install an arm 37 with two bolts at inner end, to ring 26.
12. Install angle brace 37*a* with one bolt to outer end of bar member 37, and put all thread shaft 39 at inner end through back hole of ring 38 with nut screwed thereon and screw on another nut by hand at inside of ring 28.
13. Place sleeve 46 of gage assembly 45 over support bar 26 and let the assembly rest against ring 25 at the end of bar 49.
14. Adjust the two nuts on threaded shaft 39 until the template end of bar 47 just touches bar member 37.
15. Repeat steps 11–14 for the remaining bar members 37, preferably a total of twenty-four bar members 37.
16. Fix an assembly clip 55 to grip two cross members 47 and place clip 55 across a bar member 37 adjacent the innermost slot 54 therethrough.
17. Insert two connector members 52 with the formed portions 53 through the slot 54, as shown in FIG. 9, and bolt the connector members 52 to the respective cross members 47 through bolt slots 51 thereof.
18. Repeat steps 16–17 for all of the cross members 47–49, until the complete parabolic contour frame is completed.
19. Fill frame openings with sheet metal segments, using the strips 60, or fix screen wire over each segment between adjacent bar members 37 with sheet metal screws. Adjacent screen wire segments should be overlapped only along the outer surfaces of the bar members 37.
20. Readjust all of the bar members 37 to the true parabolic contour by again using gage 45 according to step 14.
21. Check tightness of all nuts and bolts used in the assembly to insure that the assembly is rigid, at the same time making sure that all of the outer parabolic surfaces of the bar members 37 and cross members 47–49 are in proper flush alignment.
22. When the frame segments have been covered with wire screen, drive sheet metal screws at the cross members, and trim the wire screen with shears, as necessary.
23. Align four holes provided in ring 26 with the corners of square frame 25, and then remove bracket 33 and roller 34 to let ring 28 move against the square frame, and connect ring 28 to square frame 25 using brackets 70 and suitable bolts.

The earth station antenna, although of large size, customarily of a diameter of twelve feet, may be easily assembled by two workers in a short time. During assembly of the ribs 37 and cross members 47–49 and the filler panels or screen, workmen on the ground can assemble the elements by rotating ring 28 to bring the portion being worked on to near ground level. The assembly may be kept in substantial balance by assembling opposite parts, and ring 28 may be fixed against rotation by suitable clamping of the ring to frame 25, or the like.

The earth station antenna may be shipped and transported disassembled, and readily assembled at the point of use. The antenna is highly efficient in use, since its shape is more truly parabolic than other antenna known in the art, and can be tuned to maximize reception by adjustments of the nuts on the all-threaded inner ends of the angle braces for the ribs 37.

While preferred embodiments of the apparatus and methods according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Earth station antenna apparatus, comprising an upright tubular polar support, a polar connection having a part rotatable in said polar support and a movable part having an inner side pivotably connected thereto and pivotally movable in a vertical plane, said movable part having a vertically slotted yoke at its outer side, a mounting bar fixed at its center through said yoke, a square base frame pivotally connected at the centers of opposite sides to opposite ends of said mounting bar whereby said frame is rotatable about said pivotal connections thereof to said mounting bar, said square base frame carrying a cylindrical mounting rod extending transversely outwardly through the center of said square base frame, a short cylindrical support tube having its axis coaxial with the axis of said mounting rod and being supported by plural diametric cross members having holes at their crossed centers through which said mounting rod is closely yet slidably and rotatably disposed, said square base frame having removably mounted below its lower side an outwardly facing roller which engages the lower inner edge of said cylindrical support tube as said support tube is rotated about said mounting rod to maintain said support tube at a fixed distance from said square base frame during assembly of the apparatus, plural arm members each curved to have an outer face of parabolic curvature, said arm members each being bolted at their inner ends to the outer edge of said cylindrical support tube and said end members being disposed equally circularly spaced about said support tube and each extending radially outward whereby said outer faces thereof define a parabolic contour, an angular brace member connected to an outer portion of each said arm member and extending angularly radially inward to terminate in an inwardly directed threaded rod fixed thereto, each said threaded rod end being received through an opening through the inner edge of said support tube axially inward from the bolt connecting the respective arm member to the inner side of said support tube, whereby nuts screwed onto said threaded rod inward and outward of the wall of said support tube may be adjusted to adjust the effective length of the angular brace member and thereby to adjust the position of the arm member to adjust said parabolic outer face thereof accurately to said parabolic contour, plural cross members connected between said arm members at each of plural distances from the axis of said mounting rod and including a distance at the outer ends of said arm members and stabilizing said arm members, having outer faces further defining said parabolic contour, said plural arm members and said cross members defining segments of said parabolic contour therebetween, and surface means fixed to said arm members and cross members around said segments to provide an antenna surface at said parabolic contour, said removably mounted roller when removed permitting rigid connection of said support tube to said square base frame after said antenna surface has been completed.

2. The combination of claim 1, said cross members being connected at each end to a said arm member by connection means comprising a flat bar bolted to the cross member and having an offset portion engaged through a slot through said arm member, said offset portions being half-width portions whereby said offset portions connecting ends of two said cross members at opposite sides of a said arm member are engaged in half-portions of a single said slot through said arm member.

3. The combination of claim 2, said apparatus including an assembly clip for use in assembling the apparatus, each said cross member and arm member having an L-shaped cross section and said parabolic faces thereof being at the outer surface of one plate formation thereof, said clip comprising a plate having a lateral return bend portion at each end thereof, each return bend being slid over said one plate formation at the ends of cross members at opposite sides of a said arm member and the central portion of said clip plate bridging flushly over the one plate formation of the arm member whereby said parabolic faces of said arm member and said cross members are held aligned while said connection means are assembled to connect them together.

4. The combination of claim 1, said surface means comprising segments of wire screen, said screen segments being fixed to said contour segments by plural sheet metal screws screwed through said outer faces of said cross members and said cross member segments, said screen segments of adjacent said contour segments being overlapped at said outer faces and fixed by common sheet metal screws.

5. The combination of claim 1, said surface means comprising segments of sheet metal, strips clamped along said outer faces of said cross members and said arm members, said strips having longitudinal slots at their opposite sides to receive the edges of adjacent said sheet metal segments.

6. Method for assembling a parabolic earth station antenna, comprising providing a ring shaped support rotatable about its axis, connecting a plurality of radially disposed parabolically curved ribs to said support by rotating said support so that said ribs may be connected from ground level, connecting circularly disposed cross members between said ribs to form a parabolic frame by rotating said support so that said cross members may be connected from ground level, and connecting surface means between said ribs and cross members to form a parabolic antenna surface by rotating said support so that said connections may be made from ground level.

7. Method according to claim 6, including mounting a radially disposed gage for rotation about the axis of said support, and rotating said gage to determine the parabolic contour of said antenna.

8. Method according to claim 6, including supporting each said rib by an angular length-adjustable back brace extending between the rib and said support, and aligning all of said ribs in a parabolic contour by rotating a parabolic alignment gage about the axis of said support and adjusting said length adjustable brace to bring each said rib to said parabolic contour.

9. Method according to claim 6, including connecting the ends of said cross members to a said rib by clamping the cross member ends in an alignment clip bridging the rib and bolting connector elements inserted through a common slot in the rib to each cross member.

* * * * *